United States Patent [19]

Lacasse

[11] 4,135,463

[45] Jan. 23, 1979

[54] MOUNTING ARRANGEMENT FOR A SEWING MACHINE

[76] Inventor: Réjean Lacasse, 167 St. François St., St. Pie de Bagot, Canada

[21] Appl. No.: 863,577

[22] Filed: Dec. 21, 1977

[51] Int. Cl.[2] ..... A47B 81/00; D05B 75/00

[52] U.S. Cl. ..... 112/217.1; 312/29

[58] Field of Search ..... 112/217.1, 258 A, 260; 312/29

[56] References Cited

U.S. PATENT DOCUMENTS

| | | | |
|---|---|---|---|
| 540,516 | 6/1895 | Rowlett | 312/29 |
| 2,790,689 | 4/1957 | Hubbell | 312/29 X |
| 3,468,589 | 9/1969 | Maynard | 112/217.1 |

FOREIGN PATENT DOCUMENTS

| | | | |
|---|---|---|---|
| 509347 | 3/1952 | Belgium | 312/29 |

*Primary Examiner*—Henry Jaudon

[57] ABSTRACT

A mounting arrangement for a sewing machine is disclosed. The mounting arrangement comprises a base for receiving the sewing machine, guide means vertically mounted on opposite sides of the sewing machine cabinet for guiding the base in its movement between two vertical positions, spring means joining the base and the cabinet for counterbalancing the weight of the sewing machine, and indexing means mounted on the cabinet for engaging the base, so as to position such base at anyone of the two vertical positions.

2 Claims, 4 Drawing Figures

MOUNTING ARRANGEMENT FOR A SEWING MACHINE

FIELD OF INVENTION

This invention relates to a mounting mechanism for sewing machines normally provided with an arm for sewing cylindrical garments, such as sleeves, and which permits use of such machines in a so-called flat bed position in addition to their regular free arm position.

BACKGROUND OF THE INVENTION

Mechanisms for operating the above sewing machines in a free arm, or a flat bed position, are already known. However, they are complicated and expensive to manufacture and are not readily or easily operable by the normal female sewing machine operator. It is therefore the object of the present invention to provide a retractable base for a sewing machine of the above type, which requires a mininum of effort to operate and which is reliable and not costly to manufacture.

SUBJECT OF THE INVENTION

The mounting arrangement, in accordance with the invention, comprises a base for receiving the sewing machine, guide means vertically mounted on opposite sides of the cabinet for guiding the base in its movement between two vertical positions, spring means joining the base and the cabinet for counterbalancing the weight of the sewing machine, and indexing means mounted on the cabinet for engaging the base so as to position such base at any one of the two vertical positions.

The guide means may consist of an elongated key element fixed to the cabinet or the base and adapted to slide in a corresponding groove in the base or the cabinet.

The indexing means preferably comprises a stop pivoted on the cabinet and teeth mounted on the base and corresponding to each desired position of the base. Spring means are provided for biasing the stop in engagement with the teeth. The teeth are preferably profiled so as to be engaged by the stop in the downward movement of the base, whereas the stop simply rides on the teeth in the upward movement of the base. Two sets of stops are preferably provided: one on each side of the base, and two corresponding sets of teeth. The stops are joined by a bar located under the edge of the cabinet facing the operator for easy access.

The teeth used to position the sewing machine into its lowered position each consists of an adjustable block secured to the base, such block being provided with a vertical slot in which may slide one of the securing screws for adjusting the height of the base below the level of the cabinet top in the lower position of the base.

SHORT DESCRIPTION OF THE DRAWINGS

The invention will now be disclosed, by way of example, with reference to the accompanying drawings, in which.

DETAIL OF DESCRIPTION OF AN EMBODIMENT OF THE INVENTION

Figure 1:
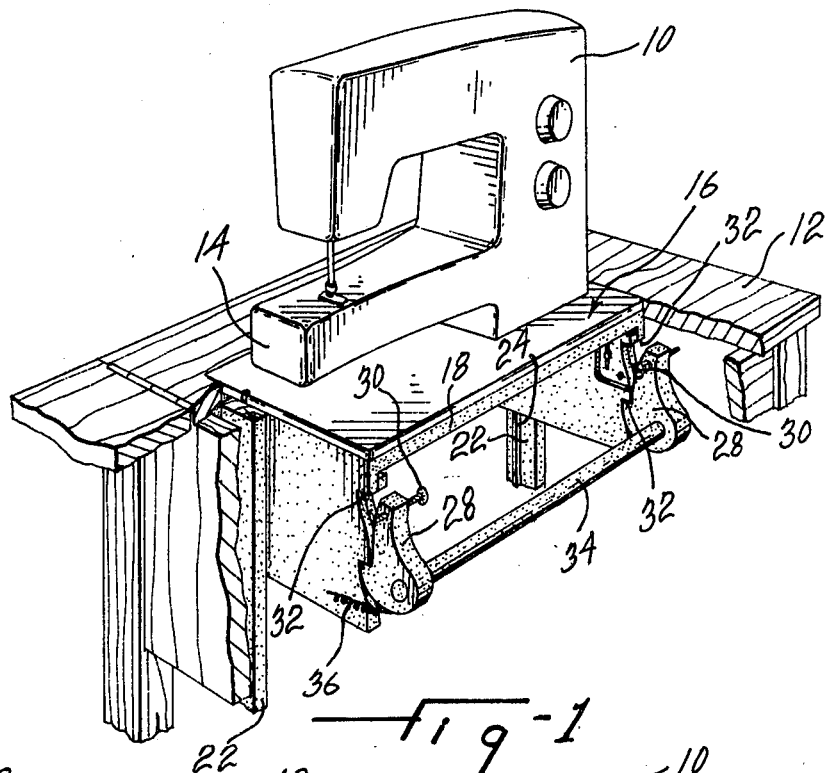
FIG. 1 illustrates a perspective view of the mounting arrangement in accordance with the invention.
Figure 4:
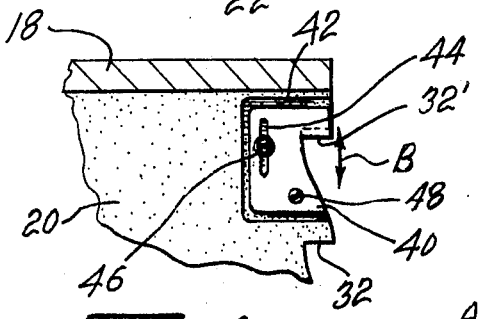
FIG. 4 illustrates the adjustable block used for accurately positioning the sewing machine in its flat bed position.
Figure 3:
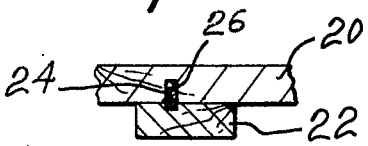
FIG. 3 illustrates a section view taken along lines 3—3 of FIG. 2.
Figure 2:
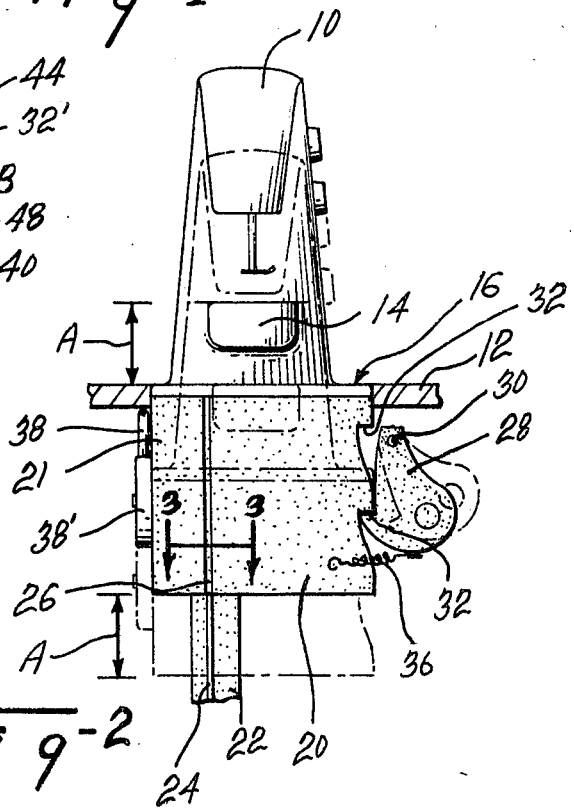
FIG. 2 illustrates a side view of the mounting arrangement showing the sewing machine in its lower position in dash lines.

Referring to FIGS. 1 and 2 of the drawings, there is shown a sewing machine 10 mounted on a suitable cabinet 12. The machine is provided with an arm 14 permitting sewing of garments of cylindrical shape, such as sleeves. The sewing machine is mounted on a base 16 consisting of a top plate 18, two side plates 20 and a back plate 21. The base is movable vertically from an upper free arm position shown in full lines in FIG. 2 to a lower so-called flat bed position illustrated in dash lines, as indicated by arrows A. To permit vertical movement of the base, the cabinet is provided with two guides 22 located one on each side of the base. As shown in FIG. 3, each of the guides includes an elongated element 24, of plastic or metal, secured in a slot in the guide. An elongated slot 26 is provided in the side plates 20 for receiving the elongated element 24. It is to be provided that other means for guiding the movement of the base 16 between its free arm and flat bed positions, are also envisaged.

Two stops 28 are pivotally mounted on the cabinet by means of screws 30. Each stop is adapted to engage a pair of teeth 32, 32' in the front edge of the side plates 20 of base 16, which correspond to the desired positions of the base. The two stops 28 are joined by a bar 34 located under the edge of the cabinet for easy operation of the stops and are biased in contact with the teeth by a spring 36. The teeth 32, 32' are profiled to be engaged by the stops 28 in the downward movement of the base, whereas the stops simply ride on the teeth in the upward movement of the base. The stops 28 and their rod 34 may be made of wood or any other suitable material.

Suitable spring means, such as a flat spring 38, secured at its free end to the cabinet and rolled up in a coil housed in a casing 38', secured to the back plate 21 of base 16, serve to counterbalance the weight of the sewing machine. The strength of the spring must be sufficient to compensate for the weight of the sewing machine and base, but, obviously, not enough to pull the base back up when it is lowered.

The flat bed position of the base is made adjustable, as it is illustrated in Figure of the drawings, to accommodate various arm heights (length of arrow A in FIG. 2). To that effect, an adjustable block 40, shaped to form an upper tooth 32', is mounted in a suitable recess 42 in each side plate 20 of base 16. The adjustable block 40 is provided with a slot 44 which permits sliding of the block for adjustment prior to tightening of securing screw 46, as indicated by arrow B. A blocking screw 48 is provided for permanently securing block 38 when suitable adjustment has been made.

The arrangement in accordance with the invention operates as follows:

When the sewing machine is utilized for its normal intended use, which is to sew garments, such as sleeves, the base is in its upper position with the stops 28 engaging lower teeth 32 under the biasing force of springs 36. If it is desired to operate the sewing machine in its flat bed position, the operator simply pulls on bar 34 to withdraw both stops 28 from engagement with lower teeth 32. The sewing machine falls automatically into its lower position, under the cushioning effect of spring 38, with the stops 28 engaging the upper teeth 32' in blocks 40. When it is desired to bring the machine back to its free arm position, it is only necessary for the operator to pull up on the head of the sewing machine without even having to touch the bar 34. The effort required to bring the machine back to its upper position will be a minimum, because of the assistance of the springs 38, as mentioned previously.

Although the invention has been disclosed with reference to a preferred embodiment thereof, it is to be understood that it is not to be limited by such embodiment; for example, the shape of the guide means for guiding the movement of the base between its two vertical positions, may vary. Various types of springs may also be used to counterbalance the weight of the sewing machine. Other types of indexing mechanisms to position the base at one of its two vertical positions, are also envisaged.

What I claim is:

1. An arrangement for mounting a sewing machine having a free arm in a sewing machine cabinet, comprising:

(a) a vertically movable base for receiving the sewing machine, said base consisting of a table top and depending side plates and back plate;

(b) a guide means vertically mounted on opposite side of the base for guiding the base in its movement between two vertical positions, said guide means consisting of an elongated key element fixed to each side of the cabinet and adapted to slide in a corresponding groove in each side plate of said base;

(c) spring means joining the base and the cabinet for counterbalancing the weight of the sewing machine, said spring means consisting of a casing secured to said back plate and a coiled flat spring housed in said casing, the free end of said flat spring being attached to the cabinet top; and (d) indexing means mounted on the cabinet for engaging said base so as to position the base at any one of said two positions, said indexing means including two stops each pivoted at its top end to the respective side of said cabinet in a vertical plane containing the side plates of said base and for movement toward and away from said side plates, said two stops being joined together at their lower end by a horizontally extending handle-bar located at a distance under the front edge of said cabinet and facing the operator for easy access thereto, each stop having an upwardly facing tooth at its rear edge and formed at the lower end of said stop and at the level of said cross-bar, each side plate having a set of two vertically spaced and downwardly facing teeth each for complementary engagement with the tooth of the associated stop for positioning the base in either of said two positions, each set of two teeth being formed at the front edge of each side plate, and biasing means in the form of a tension spring attached to the lower end of a stop and to the cabinet and biasing said stops to an engaged position with said teeth of said side plates.

2. An arrangement as defined in claim 1, wherein the upper teeth of said side plates used to position the sewing machine to its lower position each consists of an adjustable tooth-shaped block secured to the side plate by a securing screw, said block being provided with a vertical slot in which may slide said securing screw for adjusting the height of the base below the level of the cabinet in the lower position of the base.

* * * * *